United States Patent [19]

Faw

[11] Patent Number: 4,823,528

[45] Date of Patent: Apr. 25, 1989

[54] LOG WALL AND CORNER JOINT FOR LOG BUILDING STRUCTURES

[76] Inventor: Garland Faw, Rte. 11, Box 525-D, Salisbury, N.C. 28144

[21] Appl. No.: 10,326

[22] Filed: Feb. 3, 1987

[51] Int. Cl.[4] ..... E04B 1/10

[52] U.S. Cl. ..... 52/233; 52/285; 52/286; 52/585

[58] Field of Search ..... 52/233, 284, 285, 286, 52/585, 594, 227; 411/103, 105, 176, 177, 180, 123, 124, 134, 135; 446/106

[56] References Cited

U.S. PATENT DOCUMENTS

| | | | |
|---|---|---|---|
| 431,296 | 7/1890 | Vaughan | 411/123 |
| 678,052 | 7/1901 | Slye | 52/233 |
| 717,321 | 12/1902 | Ball | 411/123 |
| 732,166 | 6/1908 | Callahan | 411/124 |
| 755,749 | 3/1904 | Cooley | 52/284 |
| 1,402,438 | 1/1922 | Nichols | 52/233 |
| 1,445,738 | 2/1923 | Adams | 52/233 |
| 1,980,660 | 11/1934 | Bonn | 52/233 |
| 2,040,110 | 5/1936 | Tahvonen et al. | 52/233 |
| 2,110,787 | 3/1938 | Brandjord | 52/233 |
| 2,320,466 | 6/1943 | Presley | 52/233 |
| 2,403,934 | 7/1946 | Lindstrom | 52/233 |
| 2,416,162 | 2/1947 | Drake | 52/284 |
| 2,563,703 | 8/1951 | Bonney | 52/233 |
| 2,619,686 | 12/1952 | Dombrowski | 52/233 |
| 2,635,303 | 4/1953 | Poynter | 52/233 |
| 2,669,060 | 2/1954 | Kalvig | 52/233 |
| 2,946,150 | 7/1960 | Houk | 52/233 |
| 3,449,875 | 7/1969 | Snedeker | 52/284 |
| 3,460,301 | 8/1969 | Davis | 52/233 |
| 3,908,322 | 9/1975 | Shoaf | 52/233 |
| 4,056,906 | 11/1977 | Elfstrom | 52/233 |
| 4,147,000 | 4/1979 | Lewandowski | 52/233 |
| 4,277,925 | 7/1981 | Kinser | 52/233 |
| 4,279,108 | 7/1981 | Collister, Jr. | 52/233 |
| 4,320,610 | 3/1982 | Rupp | 52/233 |
| 4,463,532 | 8/1984 | Faw | 52/233 |
| 4,503,647 | 3/1985 | Post | 52/233 |
| 4,688,362 | 8/1987 | Pedersen et al. | 52/233 |

FOREIGN PATENT DOCUMENTS 2615891 10/1977 Fed. Rep. of Germany .

OTHER PUBLICATIONS

Mechanix Illustrated, Jan., 1982, (Brochure), Article from American Builder, Feb., 1933.

*Primary Examiner*—John E. Murtagh
*Assistant Examiner*—Caroline D. Dennison
*Attorney, Agent, or Firm*—Shefte, Pinckney & Sawyer

[57] ABSTRACT

An improved manner of log wall and corner joint construction in log building structures utilizes log units of a rectangular cross-sectional shape with end portions having square notches formed in opposed stacking surfaces of the log units permitting stacking of the log units in coplanar relation with their notched end portions matingly interdigitated to insure proper plumbness of the resultant corner joint and walls. Wooden spacer members are stacked in alternate relation with the log units and painted with a sand paint to simulate traditional mortar joints between adjacent log units without the disadvantages of such joint construction. The log units within each wall and at each corner joint are interconnected by a plurality of connecting rods extending transversely through the entirety of the log units at periodic longitudinal spacings. Spacer members are provided between the supporting foundation and the lowermost log units in the log walls to permit ready access to the connecting rods for periodic tightening as necessary or desirable to close gaps forming over time as a result of shrinkage, warping or settlement of the log walls.

9 Claims, 3 Drawing Sheets

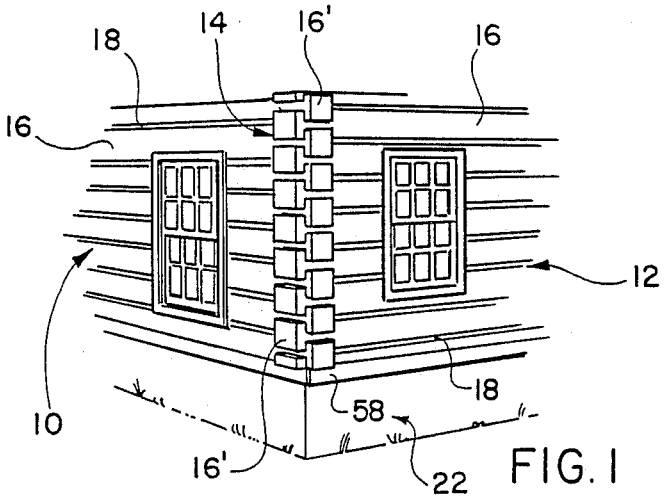
FIG. 1
FIG. 4
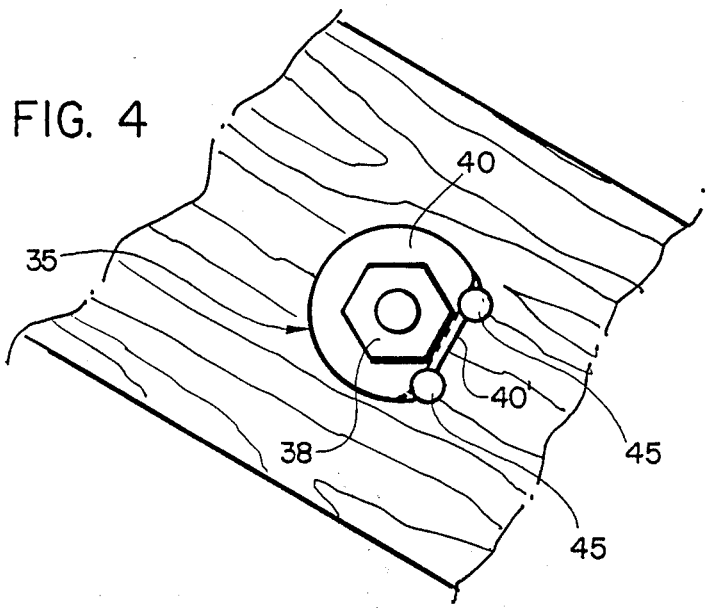

LOG WALL AND CORNER JOINT FOR LOG BUILDING STRUCTURES

BACKGROUND OF THE INVENTION

The present invention relates generally to the construction of building structures utilizing relatively stacked log units and, more particularly, relates to a novel arrangement for connecting a plurality of relatively stacked log units together to form a log wall, to a novel arrangement for providing a log wall with the traditional appearance of mortar joints between stacked log units without the attendant disadvantages of such traditional construction, and to a novel corner joint connecting angularly adjoining log walls.

In recent years, the use of wooden logs in stacked relationship as a manner of constructing walls in building structures, particularly homes, has become increasingly popular in view of the natural insulative properties of wood, the aesthetically pleasing rustic appearance of log walls, and the greater simplicity of this manner of construction resulting from contemporary improvements in the art of log building construction enabling the controlled machining of wooden logs to uniform shape and dimensions permitting such logs to be properly assembled in stacked relation by unskilled labor and so-called "do-it-yourselfers."

For centuries, log building structures have utilized relatively unfinished rounded logs manually notched at their ends and stacked into respective log walls with the notched ends of the logs of adjoining walls alternately overlapping one another with their notches relatively engaged. Gaps, or so-called "chinks," which are inherently left between relatively stacked walls due to the notched corner construction as described, have been traditionally filled with a mud or cement-like mortar. The obvious disadvantages of this time-honored but primitive manner of building construction are its requirement for a time-consuming amount of skilled heavy manual labor, the inherent impreciseness of construction resulting from irregularly-shaped logs and the significant loss of the insulative properties of logs resulting from the necessary mortar joints.

A number of contemporary improvements in log building construction have reduced these disadvantages to a reasonable degree. Conventionally, logs are carefully machined to uniform shapes and dimensions to permit more precise stacking of machined log units with respect to one another, as aforementioned. The practice of forming such machined log units with mortise-and-tenon corner joints has also come into increasing conventional use to eliminate the traditional overlapping notched construction of log wall corners, thereby permitting log units to be stacked in direct engagement with one another to eliminate intermediate gaps requiring mortar while at the same time providing a uniform corner appearance. To provide structural integrity between stacked log units in a log wall, various arrangements of spikes or the like have been developed to permit stacked log units to be connected with one another into an integral wall.

The aforementioned improvements have substantially advanced and promoted wider acceptance of logs as a conventional building component. However, certain problems continue to exist in conventional log building construction components and methods. While the use of spikes or the like for integrating stacked log units serves to integrate stacked log units into a structurally sound wall under ordinary circumstances, provided that a sufficient number of spikes are utilized at appropriately close spacings along the full length of a log wall, the natural shrinkage, warping and settling of logs sometimes causes undesirable gaps or spacings to form over time between adjacently stacked log units despite the careful placement of the spikes. According to conventionally accepted construction techniques, such spikes normally connect only adjacent pairs of log units, thereby requiring an appropriate series of spaced spikes to connect each course of log units in the stacking process. As a result, it is impossible to correct gaps and spaces forming subsequent to the initial erection of a log wall. Further, this technique requires a significant amount of time-consuming manual labor to install the necessary spikes during the initial erection of such log walls, which is viewed by many building contractors and potential purchasers as a substantial disadvantage. It has been found that at least some contractors and purchasers tend to install fewer spikes than are recommended in order to reduce the required construction time and labor, which over time only serves to compound the possible occurrence of gaps and spaces between log units. Similarly, while the use of mortise-and-tenon corner joints in log structures has significantly improved the formation of log building corners, some tendency nevertheless exist that such log corners may be constructed out of proper vertically plumbed disposition and may produce some misalignment of the stacked log units making up the corner construction if the mating mortise and tenon portions of the log units are not precisely machined and if they are not carefully assembled in proper relation to one another. Finally, most existing manufacturers of machined log units cut the log units to a considerably smaller size than that of tree-size logs such as have been historically used in log structures constructed according to traditional techniques as aforedescribed. This factor, together with the directly stacked arrangement of such log units without intermediate gaps, produces a log wall appearance which differs to a reasonably significant degree from that of traditional log buildings, which is viewed negatively by some potential purchasers.

Accordingly, a need continues to exist in the contemporary log construction industry for a manner of log wall and corner joint construction which utilizes the advantages of precisely machined log units for producing log building structures having a traditional appearance with minimal occurrence of gaps or spaces between stacked log units.

SUMMARY OF THE INVENTION

According to one feature of the present invention, a log wall for use in a log building structure is constructed of a plurality of elongate log units arranged coplanarly in stacked relationship along respective longitudinal stacking surfaces thereof. The stacked log units have a plurality of openings extending therethrough transversely with respect to their stacking surfaces at spacings along the log units. A plurality of connecting rods extend respectively through the aligned openings with each rod having opposite end portions which are respectively exposed outwardly adjacent the opposite outwardmost-stacked log units. A first arrangement is provided for engaging one exposed end portion of each rod and being fixed with respect to the adjacent outwardmost-stacked log unit. A second arrangement threadedly engages the other exposed end portion of each rod for enabling periodic selective tightening movement therealong for maintaining the log units in their stacked relation against any tendency to separate from one another due to shrinkage and settlement of the log units.

In the preferred embodiment, the first rod-engaging arrangement includes a nut assembly threadedly engaging the one exposed end portion of each rod, the nut assembly being fixed in relatively rigid engagement with the adjacent outwardmost-stacked log unit. This nut assembly preferably includes a nut member and a washer member rigidly affixed to one another with the washer member having a flat outer edge tightened into engagement with the adjacent outwardmost-stacked log unit so as to be fixed with respect thereto. As desired, a retaining member such as a nail or the like may be engaged in the adjacent outwardmost-stacked log unit alongside the flat outer edge of the washer member to assist in maintaining the nut assembly fixed with respect to the log unit. The second rod-engaging arrangement includes a nut member which threadedly engages the other exposed end portion of each rod to permit selective tightening movement therealong.

The log wall is preferably constructed with its log units extending generally horizontally with the lowermost-stacked log unit supported on a building foundation. The aforesaid other exposed end portion of each rod and their mating nut members are disposed adjacent the lowermost log unit, the building foundation including spacer members for supporting the lowermost log unit to provide access spacings to the nut members of the second rod-engaging arrangement at each such other exposed end portion of the rods to facilitate their periodic selective tightening.

According to another feature of the present invention, a plurality of elongate spacer members are arranged to alternately stacked coplanar relationship with the log units of the log wall with one spacer member disposed intermediate each adjacently stacked pair of the log units. Each spacer member includes respective longitudinal stacking surfaces for engagement with the corresponding stacking surfaces of the adjacently stacked pair of log units. Each spacer member further includes an outwardly exposed face of a mortar-like surface appearance extending between the adjacently stacked pair of log units to provide an appearance to the log wall resembling a traditional log wall construction having mortar joints between stacked logs. Preferably, a substantially flat wooden board is utilized as each spacer member with the outwardly exposed face of the wooden spacer member being covered by a mixture of sand and a paint material to provide the desired mortar-like surface appearance.

According to a further feature of the present invention, a second plurality of stacked elongate log units is connected with the first-mentioned plurality of stacked log units in a corner joint whereat respective notched end portions of each log unit are alternately overlapped with one another in interdigitated fashion with their respective notches in mating engagement with one another to form the corner joint. Each log unit of each plurality thereof is provided with opposed substantially flat longitudinal stacking surfaces for arranging the log units in their coplanar stacked relationship and each log unit is further provided with opposed substantially flat longitudinal wall surfaces extending orthogonally between its stacking surfaces. The notch in the overlapping end portion of each log unit is formed in each stacking surface of the log unit in an orthogonal configuration with respect to the stacking surfaces and to the wall surfaces for mating engagement with the corresponding orthogonal notch in the adjacently engaged lot unit. In this manner, the corner joint achieves the overlapping interengaged appearance of traditional log building structures while being precisely machined to provide precise secure mated engagement between the respective end portions of the log units.

BRIEF DESCRIPTION OF THE DRAWINGS

FIG. 1 is a perspective view of two adjoining exterior log walls with a corner joint therebetween constructed according to the preferred embodiment of the present invention;

FIG. 4 is a partial plan view of one of the log walls of FIG. 1.

DESCRIPTION OF THE PREFERRED EMBODIMENT

Figure 2:
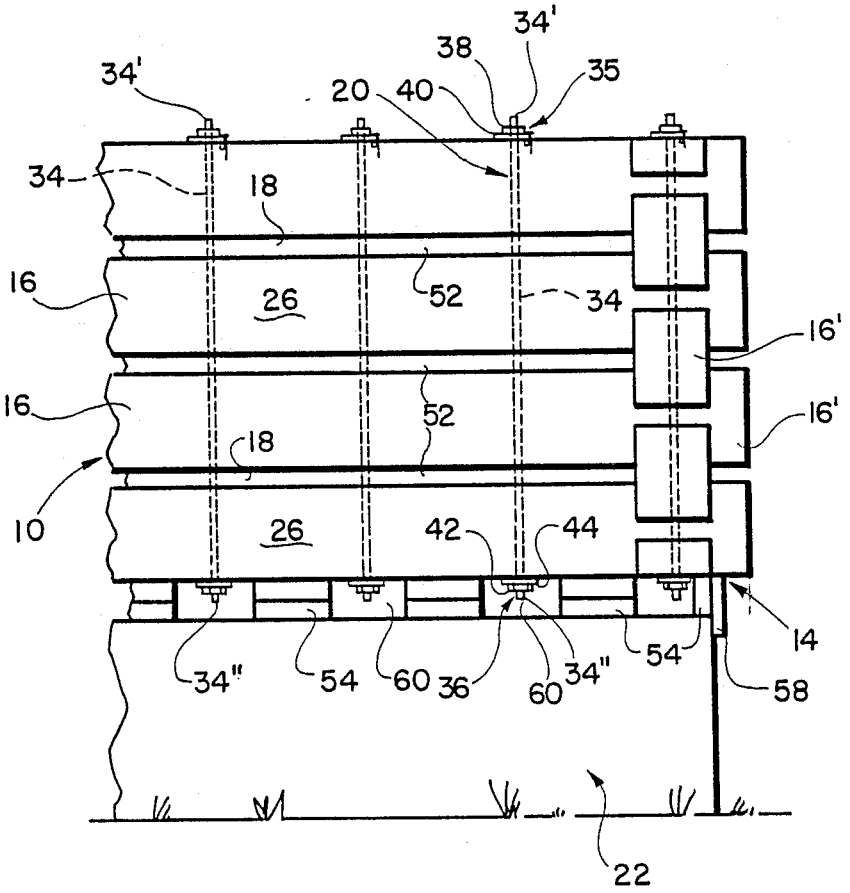
FIG. 2 is a partial front elevational view of the front log wall and corner joint of FIG. 1.

Referring now to the accompanying drawings and initially to FIG. 1, two log walls are indicated generally at 10 and 12, respectively, in perpendicularly adjoining relation with their respective adjacent ends interconnected in a corner joint, indicated generally at 14, in accordance with the preferred embodiment of the present invention to form the upright front and an adjoining side wall of a log building structure such as a log home. Of course, as will be understood, the complete building structure includes other log walls (not shown) of corresponding construction and corner interconnection about the remaining perimeter of the structure. As more fully explained hereinafter, each log wall 10, 12 is fabricated of a plurality of elongate log units 16 and elongate spacer members 18 arranged coplanarly in alternately stacked relationship. Each of the log units 16 in each log wall 10, 12 has notched end portions 16' which are alternately interdigitated with the log units 16 of the other log wall 10, 12 in overlapping relation to form the corner joint 14. A plurality of connecting rod assemblies, indicated generally at 20, extend through the entire transverse extent of each log wall 10, 12 at periodic spacings along their respective lengths and at the corner joint 14 therebetween. The log walls 10, 12 are supported on a foundation, generally indicated at 22, which may be of any conventional brick, concrete, stone or other suitable construction.

Figure 3:
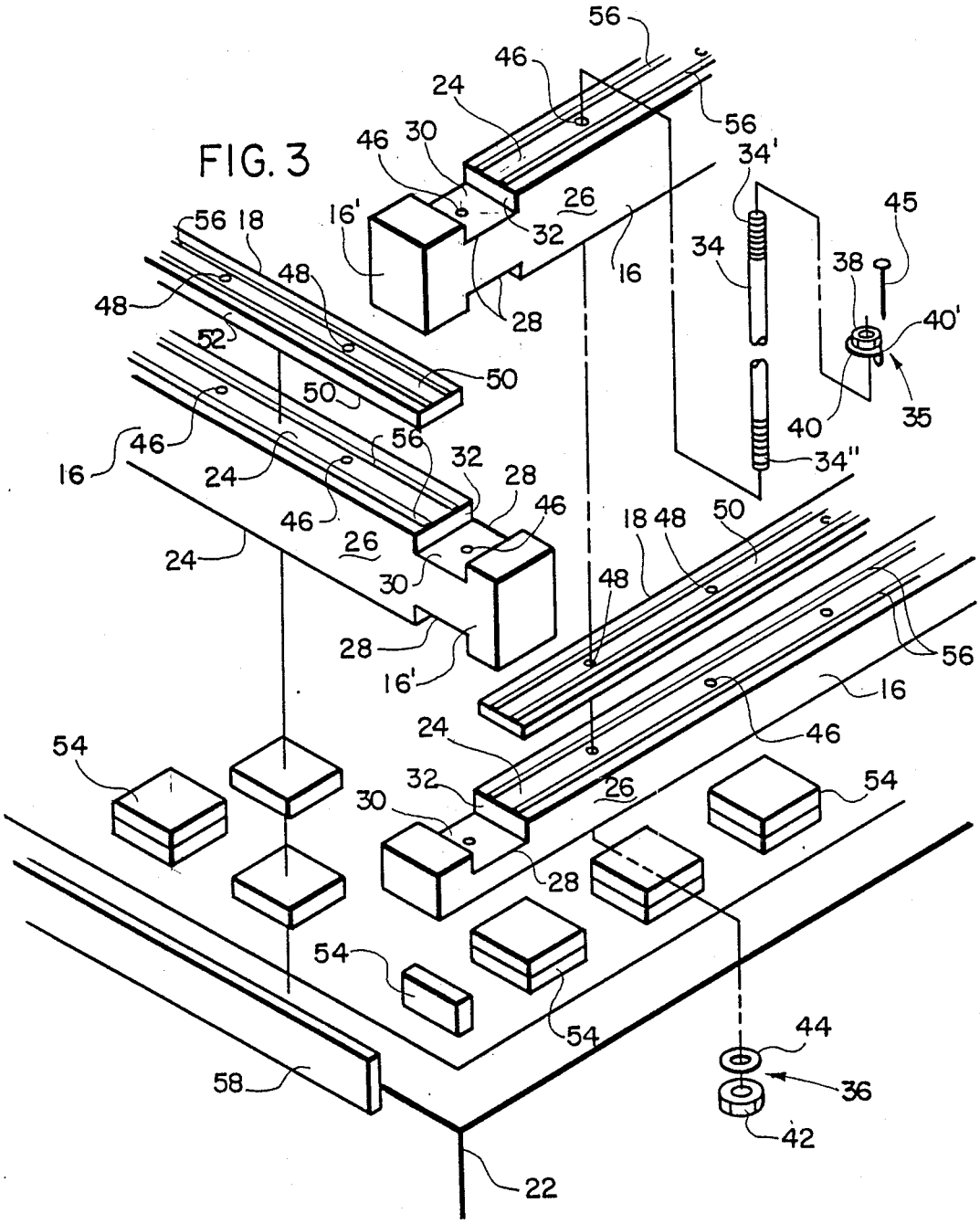
FIG. 3 is a partial exploded perspective view of the log walls and corner joint of FIG. 1.

As best seen in FIG. 3, each log unit 16 of each log wall 10, 12 is machined to a four-sided orthogonal cross-sectional shape uniformly along the entire longitudinal extent of the log unit 16. Preferably, each log unit 16 is of a rectangular cross-section eight inches in width and ten inches in height for greater strength and insulative character than conventional log units of smaller cross-sectional area. Thus, the widthwise longitudinally extending surfaces 24 of each log unit 16 provide substantially flat top and bottom stacking surfaces in opposed parallel relation to one another, while the heightwise longitudinally extending surfaces 26 of each log unit 16 similarly provide substantially flat front exterior and back interior wall surfaces extending in opposed parallel relation to one another orthogonally between the front and rear lateral side edges of the stacking surfaces 24. An end portion 16' of each log unit 16 is formed with an orthogonal notch 28 in each of the top and bottom stacking surfaces 24 at a short spacing from the outward cross-sectional end face of the log unit 16. Each notch 28 is formed to a uniform depth defined by a flat substantially square bottom face 30 extending between the wall surfaces 26 in perpendicular relation thereto and in parallel relation to the adjacent stacking surface 24 and by rectangular opposed facing side faces 32 extending perpendicularly with respect to the bottom face 30 between the wall surfaces 26 in perpendicular relation thereto and extending between the bottom face 30 and the adjacent stacking surface 24 in perpendicular relation to each thereof. The spacer members 18 are preferably formed of conventional wooden boards two inches in height and six inches in width and of any suitable length corresponding to the length of the log units 16 or any appropriate divisible thereof. Thus, the opposed widthwise surfaces 50 of each spacer member 18 provide substantially flat longitudinally extending parallel top and bottom stacking surfaces, while the opposite heightwise surfaces 52 of each spacer member 18 provide substantially flat longitudinally extending parallel front exterior and back interior wall surfaces. As desired, the front exterior wall surface 52 may be painted, coated or otherwise textured to provide a contrasting appearance to that of the front exterior wall surfaces 26 of the log units 16 to resemble the appearance of mud or cement mortar such as used in traditional log building construction. Preferably, a so-called sand paint, having a mixture of sand and a paint material, in an appropriate gray color is used to provide this desired appearance effect.

Each connecting assembly 20 includes a cylindrical steel rod 34 of a length slightly greater than the intended height of the log walls 10, 12 with the opposite ends 34' of each connecting rod 34 being appropriately threaded. Two nut and washer assemblies, generally indicated at 35 and 36, respectively, are provided for threaded engagement on the opposite ends 34', 34" of the connecting rod 34. The nut and washer assembly 35 includes a threaded nut 38 and an annular washer member 40 rigidly welded integrally in coaxial relation with one another with the washer member 40 having a flattened side edge 40' extending in a chord-like fashion at the outer periphery of the washer member 40. The other nut and washer assembly 36 is of a conventional construction including a separate threaded nut 42 and annular washer member 44. To accept the several connecting rods 34, each of the log units 16 of each log wall 10, 12, is formed with a plurality of linear bores 46 extending completely therethrough perpendicularly between the stacking surfaces 24 at periodic spacings, preferably sixteen inches, along the longitudinal center line of the log unit 16, with one bore 46 being formed perpendicularly through the end portion 16' of the log unit 16 between the faces 30 of its notches 28 at the center thereof. Similarly, each spacer member 18 of each log wall 10, 12 is correspondingly formed with a plurality of bores 48 extending completely therethrough perpendicularly between the stacking surfaces 50 at corresponding spacings along the longitudinal center line of the spacer member 18.

In erecting the log walls 10, 12 on the foundation 22, a series of spacer support blocks 54 are initially affixed to the bottom stacking surface 24 of the lowermost log unit 16 for each log wall 10, 12 at spacings therealong equidistantly intermediate the several bores 46 through the log units 16. The lowermost log units 16 of the log walls 10, 12 are then appropriately positioned along the respective front and side extents of the foundation 22 with the support blocks 54 resting on the upper surfaces of the foundation 22 to support the bottom stacking surfaces 24 of the respective log units 16 at a slight elevation above the foundation 22 to provide access spaces 60 between the foundation 22 and the lower stacking surface 24 at each bore 46, as best seen in FIG. 2. Preferably, the support blocks 54 are formed of wood from conventionally available treated lumber stock to support the lowermost log units 16 at an elevation of several inches above the foundation 22. At the same time, the respective end portions 16' of the lowermost log units 16 are arranged with one log unit 16 overlapping the other with their respective notches 28 in mating relation to partially receive an adjacent extent of the end portion 16' of the other log unit 16. As thus interengaged the bores 46 formed in the notches 18 in the end portions 16' of the log units 16 are brought into vertical alignment with one another. As best seen in FIG. 1, the lowermost log unit of the side wall 12 is of only one-half the thickness of a complete log unit 16 as used as the lowermost log unit in the front log wall 10 so that the bottom stacking surfaces 24 of the two lowermost log units 16 are in coplanar relation with one another when arranged on the foundation 22 in interconnected fashion as described. As will be understood, the corresponding lowermost log units for the remaining exterior walls of the building structure (not shown) are similarly arranged to complete the initial course of log units about the remainder of the foundation perimeter.

With the lowermost log units 16 thusly in place on the foundation 22, a single course of spacer members 18 is next positioned on the top stacking surfaces 24 of the lowermost log units 16 with the bores 48 of the spacer members 18 in alignment with the corresponding bores 46 of the lowermost log units 16. To appropriately seal the interface between the log units 16 and spacer members 18, continuous strips 56 of a suitable insulative material may be arranged between the spacer members 18 and log units 16 along the front and rear lateral portions of the spacer members 18. Preferably, each spacer member 18 is nailed to the log unit 16 immediately therebelow to insure proper relative positioning as the erection process continues. Additionally, wooden dowels (not shown) are preferably positioned in mating notches (not shown) in the end edges of the spacer members 18 to provide a secure seal between the abutting end edges of adjacent spacer members 18 in the same course. Once continuous courses of the spacer members 18 have been appropriately positioned as described on the lowermost log units 16 in each log wall of the building, a next successive log unit 16 for each log wall is stacked on the spacer members 18 with the respective notches 28 in the end portions 16' of the log units 16 being matingly engaged as aforedescribed and with the bores 46 of the log units 16 in vertical alignment with the bores 46, 48 of the previously positioned lowermost log units 16 and spacer members 18. Hereagain, to maintain proper relative positioning of the newly stacked log units 16 with respect to the spacer members 18 and the previously positioned log units 16 as the erection process continues, each newly stacked log unit 16 is preferably "toe-nailed" to the spacer member 18 therebelow. The erection of each log wall 10, 12 and all other log walls in the building structure proceeds in the same fashion as described with the log units 16 and spacer members 18 being alternately stacked in coplanar relationship along their respective stacking surfaces 24, 50 and with their respective bores 46, 48 in vertical alignment with one another. As will be understood, the uppermost log units 16 of the side log wall 12 will also be of one-half the height of a complete log unit 16 to locate its top stacking surface in coplanar relation with the top stacking surface 24 of the uppermost log unit 16 of the front log wall 10.

Upon completion of the above-described stacking operation, a connecting rod 34 is inserted downwardly from the upper extent of each log wall 10, 12 and the other log walls of the building structure through each aligned series of bores 46, 48 in the stacked log units 16 and spacer members 18 and through the aligned bores 46 of the overlapping end portions 16' of the log units 16 at the corner joint 14 and other corner joints between the walls. Each connecting rod 34 is of a sufficient length to leave its upper threaded end 34' extending outwardly exposed above the top stacking surface 24 of the uppermost log unit 16 and its lower threaded end 34" extending outwardly exposed below the bottom stacking surface 24 of the lowermost log unit 16 in the respective log wall. A welded nut and washer assembly 38, 40 is threadedly engaged on the upper end 34' of each connecting rod 34 with the washer member 40 in facing engagement with the top stacking surface 24 of the adjacent uppermost log unit 16, while the separate nut and washer assembly 42, 44 is correspondingly engaged threadedly on the exposed lower end 34" of each connecting rod 34. The upper nut and washer assembly 38, 40 on each connecting rod 34 is tightened to sufficiently tighten its washer member 40 slightly beyond flush engagement of the washer member 40 with the top stacking surface 24 of the adjacent uppermost log unit 16 to cause the flat edge 40' of the washer member 40 to partially penetrate the adjacent stacking surface 24. In this manner, the flat edge 40' of the nut and washer assembly 38, 40 at the upper end 34' of each connecting rod 34 serves to maintain the nut and washer assembly 38, 40 in substantially fixed relation with respect to its adjacent uppermost log unit 16 to avoid any tendency of the nut and washer assembly 38, 40 to rotate integrally with the connecting rod 34. As desired, one or more nails 45 may be placed in the upper stacking surface 24 of each uppermost log unit 16 immediately adjacent the flat edge 40' of each washer member 40 to insure the fixed disposition of each nut and washer assembly 38, 40 against rotation relative to the log unit 16.

As will be understood, this tightening operation serves to compress the respective log units 16 and spacer members 18 in each log wall 10, 12 and in the other log walls about the remaining perimeter of the building structure into substantially continuous surface engagement along the respective longitudinal stacking surfaces 24, 50 to close any gaps or spaces which may occur therebetween as a result of any warping or unevenness in the log units 16 and spacer members 18. Similarly, the connecting rod 34 inserted through the aligned bores 46 of the log unit end portions 16' at the corner joint 14 serves to compress the end portion 16' into close mated engagement in the respective notches 28. Following the completed erection of the log walls 10, 12 and all other log walls of the building structure in the described manner, the construction of the building structure is then completed in conventional fashion with the installation of flooring, rafters, roof, interior walls and ceilings, windows and doors. A skirtboard 58 is affixed by screws or in a similar manner to the support blocks 54 about the full perimeter of the building structure to close the open access spaces 60 left by the support blocks 54 between the foundation 22 and the lowermost log unit 16 in each log wall, while permitting easy removal of the skirtboard 58 for later readjustment of the connecting end assemblies 20, as hereinbelow described.

Advantageously, the described construction and installation of the connecting rod assemblies 20 permit their selective retightening at periodic intervals as may be necessary or desirable to further compress the log units 16 and spacer members 18 to close any gaps or spaces therebetween which may form over time as a result of shrinkage, warping or settlement of the log units 16 and spacer members 18. Specifically, as will be understood, the support blocks 54 maintain the lower ends 34" of the connecting rods 34 and their nut and washer assemblies 42, 44 conveniently exposed in the access spaces 60 formed by the support blocks 54 between the foundation 22 and the lowermost log units 16 so as to be easily accessible when desired by simple removal of the skirtboard 58. Thus, in the event any gaps or spaces form between the log units 16 and the spacer members 18 at any time following the original erection of the log walls, the nut and washer assemblies 42, 44 may be readily accessed to further tighten the connecting rod assemblies 20 as necessary. Importantly, the welded nut and washer assembly 38, 40 installed at the upper ends of the connecting rods 34 serves to insure tightening of the connecting rod assemblies 20 in spite of any tendency of any of the connecting rods 34 to rotate with the nut 42 upon its tightening movement. Since the flat edge 40' of the washer member 40 in conjunction with the retaining nails 45 rigidly secures each upper nut and washer assembly 38, 40 in fixed position with respect to the uppermost log unit 18, any unintended rotation of the connecting rod 34 will in any event result in relative tightening rotation between the upper end 34' of the connecting rod 34 and the fixed nut and washer assembly 38, 40. This ability to periodically tighten the compression of the log units 16 and spacer members 18 within the log walls 10, 12 substantially eliminates the disadvantageous tendency of conventional log wall constructions to form undesirable gaps or spacings between stacked log units as a result of shrinkage, warping or settling of the log wall over time. As will be understood, this aspect of the present invention resultingly serves to maintain and enhance the insulative properties of log walls.

The interlocking corner construction formed between log walls according to the present invention provides further structural advantages by substantially insuring that the corner joint 14 as well as the log walls 10, 12 are substantially plumb. Specifically, the provision of the interlocking notches 28 in each stacking surface 24 of each log unit 16, together with the square configuration of the notches 28, requires that each interengaging log unit 16 must be properly square and plumb with respect to the other immediately adjacent log units 16 with which it interengages in order to achieve the proper mating joinder between the end portions 16' of the log units 16. As a result, the corner joint 14 necessarily is assembled and erected in a plumb fashion as each log unit 16 is stacked and, in turn, rigidifies and insures that substantially the full longitudinal extent of the log units 16 is also maintained properly plumb. In contrast, conventional mortise-and-tenon corner joints in other log home constructions are more susceptible to being erected out of a proper plumb disposition in that such form of connection only integrates each abutting pair of log units with one another but not with adjacently stacked log units and, further, does not necessarily constrain the abutting log units into square relation with one another.

Finally, the use of the spacer members 18 serves to significantly enhance the aesthetic qualities of log building construction according to the present invention to provide an appearance which remarkably resembles that of traditional log cabins having mortar joints between adjacently stacked logs, Notably, the spacer members 18 are preferably of a slightly lesser widthwise dimension than the log units 16 to result in a recognizable distinction between each adjacently stacked pair of log units 16, but without producing any undesirable gaps or spaces between the log units 16 and without compromising the insulative properties of the log wall as a whole. Furthermore, the preferred painting of the exterior wall surface 52 of each spacer member 18 with a sand paint of a gray or similarly neutral color gives the spacer members 18 an exterior appearance which further contrasts both in surface texture and color from that of the log units 18 to enhance the simulation of mortar joints intermediate the adjacently stacked log units 18.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A log wall for use in a building structure, comprising a plurality of elongate log units arranged coplanarly in stacked relationship along respective longitudinal stacking surfaces thereof, said stacked log units having a plurality of aligned openings extending therethrough transversely with respect to their said stacking surfaces at spacings along said log units, a plurality of connecting rods extending respectively through said aligned openings, each said rod having opposite threaded end portions respectively exposed outwardly adjacent the opposite outwardmost-stacked log units, first nut means threadedly engaging one exposed end portion of each said rod and being fixed with respect to the adjacent outwardmost-stacked log unit, and second nut means threadedly engaging the other exposed end portion of each said rod for periodic selective tightening movement with respect to said log units for maintaining said log units in their said stacked relation against any tendency to separate from one another due to shrinkage, warpage and settlement of said log units, the fixed engagement of each said first nut means being effective to prevent any unitary movement of any said first nut means and its associated rod upon selective tightening movement of the associated second nut means to insure tightening of said log units in spite of any tendency of said second nut means and said rod for unitary movement.

2. A log wall according to claim 1 and characterized further in that each said first nut means includes a nut member and a washer member rigidly affixed to one another, said washer member having a flat outer edge tightened into engagement with the adjacent outwardmost-stacked log unit to be fixed with respect thereto.

3. A log wall according to claim 2 and characterized further in that each said first nut means includes a retaining member engaged in the adjacent outwardmost-stacked log unit alongside said flat outer edge of said washer member to assist in maintaining said first nut means fixed with respect to the adjacent outwardmost-stacked log unit.

4. A log wall according to claim 1 and characterized further in that each said one exposed end portion of said rods is disposed adjacent one outwardmost-stacked log unit and each said other exposed end portion of said rods is disposed adjacent the other outwardmost-stacked log unit, and characterized further by means for supporting said other outwardmost-stacked log unit for convenient access to said second nut means for selective tightening thereof.

5. A log wall according to claim 4 and characterized further in that said supporting means includes foundation means supporting said log wall in an upright disposition with said log units extending generally horizontally and said other outwardmost-stacked log unit disposed lowermost, said foundation means including spacer means supporting said other outwardmost-stacked log unit and providing access spacings to said second nut means at each said other exposed end portion of said rods.

6. A log wall according to claim 1 and characterized further by a second plurality of said log units arranged coplanarly in stacked relationship along respective longitudinal stacking surfaces and a corner joint connecting the first-mentioned plurality of stacked log units and said second plurality of stacked log units, each said log unit of each said plurality including an end portion, said log units of said first and second pluralities being arranged with their respective end portions interdigitated to form said corner joint.

7. A log wall according to claim 6 and characterized further in that said interdigitated end portions of said log units respectively have mating notches engaging one another at said corner joint.

8. A log wall according to claim 1 and characterized further by a plurality of elongate spacer members arranged in stacked relationship with said log units with one said spacer member disposed intermediate each adjacently stacked pair of said log units, each said spacer member having an outwardly exposed face of a mortar-like surface appearance extending between the adjacent pair of log units to provide an appearance to said log wall resembling a traditional log wall construction having mortar joints between stacked logs.

9. A log wall according to claim 8 and characterized further in that said stacking surfaces of each said log unit are substantially flat and extend in parallel relation to one another at opposite longitudinal sides of the log unit, each said spacer member comprising a wooden board having opposite substantially flat parallel stacking surfaces for stacking engagement with said stacking surfaces of the adjacent pair of log units.

* * * * *

UNITED STATES PATENT AND TRADEMARK OFFICE

CERTIFICATE OF CORRECTION

PATENT NO. : 4,823,528

DATED : April 25, 1989

INVENTOR(S) : Garland Faw

It is certified that error appears in the above-identified patent and that said Letters Patent is hereby corrected as shown below:

Column 2, Line 28, reads "exist" but should read -- exists --.

Column 3, Line 38, reads "to" but should read -- in --.

Column 4, Line 6, reads "lot" but should read -- log --.

Column 9, Line 13, reads "logs," but should read -- logs. --.

Signed and Sealed this

Fifteenth Day of September, 1992

*Attest:*

DOUGLAS B. COMER

*Attesting Officer*

*Acting Commissioner of Patents and Trademarks*